US007279840B2

(12) United States Patent
Chandler et al.

(10) Patent No.: US 7,279,840 B2
(45) Date of Patent: Oct. 9, 2007

(54) ELECTRODELESS FLUORESCENT LAMP WITH CONTROLLED COLD SPOT TEMPERATURE

(75) Inventors: Robert T. Chandler, Lexington, MA (US); Jakob Maya, Brookline, MA (US)

(73) Assignee: Matsushita Electric Works Ltd., Osaka (JP)

( * ) Notice: Subject to any disclaimer, the term of this patent is extended or adjusted under 35 U.S.C. 154(b) by 0 days.

(21) Appl. No.: 10/991,304

(22) Filed: Nov. 17, 2004

(65) Prior Publication Data

US 2006/0103314 A1 May 18, 2006

(51) Int. Cl.
*H01J 17/16* (2006.01)
*H01J 61/52* (2006.01)
*H01J 1/50* (2006.01)

(52) U.S. Cl. ..... 313/634; 313/44; 313/161

(58) Field of Classification Search ..... 313/634, 313/44–47, 160–161, 493; 220/2.1 R, 2.2; 315/248, 117, 344
See application file for complete search history.

(56) References Cited

U.S. PATENT DOCUMENTS

| | | | | |
|---|---|---|---|---|
| 4,093,889 | A | 6/1978 | Bloem et al. | |
| 4,694,215 | A * | 9/1987 | Hofmann | 313/44 |
| 4,797,595 | A * | 1/1989 | De Jong | 313/493 |
| 5,559,392 | A * | 9/1996 | Cocoma et al. | 313/490 |
| 5,581,157 | A * | 12/1996 | Vrionis | 315/117 |
| 5,723,947 | A * | 3/1998 | Popov et al. | 313/634 |
| 5,769,530 | A | 6/1998 | Biro et al. | |
| 5,773,926 | A | 6/1998 | Maya et al. | |
| 5,808,418 | A | 9/1998 | Pitman et al. | |
| 5,905,344 | A | 5/1999 | Vrionis | |
| 6,124,679 | A | 9/2000 | Vrionis | |
| 6,172,452 | B1 | 1/2001 | Itaya et al. | |
| 6,175,197 | B1 | 1/2001 | Kling | |
| 6,222,318 | B1 | 4/2001 | Oomen et al. | |
| 6,359,376 | B1 | 3/2002 | Hollstein et al. | |
| 6,433,478 | B1 | 8/2002 | Chandler et al. | |
| 6,555,954 | B1 * | 4/2003 | Chandler et al. | 313/485 |
| 6,630,779 | B1 * | 10/2003 | Tokes et al. | 313/493 |
| 2002/0070661 | A1 * | 6/2002 | Shaffer | 313/490 |

FOREIGN PATENT DOCUMENTS

EP 0 987 737 A1 3/2000

* cited by examiner

*Primary Examiner*—Mariceli Santiago
*Assistant Examiner*—Anne M Hines
(74) *Attorney, Agent, or Firm*—Wolf, Greenfield & Sacks, P.C.

(57) ABSTRACT

An electrodeless lamp includes a bulbous lamp envelope enclosing an inert gas and a vaporizable metal fill, the lamp envelope having a reentrant cavity; an electromagnetic coupler positioned within the reentrant cavity; and a cold spot structure configured for low temperature, low duty cycle operation and for room temperature, 100% duty cycle operation. In some embodiments, the cold spot structure includes a dimple in the lamp envelope, the dimple having a thinned sidewall. In further embodiments, a shield is positioned near the dimple to control cold spot temperature. In additional embodiments, the cold spot structure includes a heat sink attached to the exhaust tube of the lamp envelope and thermally isolated from the lamp base.

15 Claims, 11 Drawing Sheets

150W Electrodeless Lamp

| | Lamp Configuration | Cold Spot Temperature (°C) |
|---|---|---|
| 1 | The Standard Lamp with Heat Conductive Rod and Transistor Heat Sink. (Fig. 4) | 44 |
| 2 | The Extended Exhaust Lamp with Transistor Heat Sink (Fig. 5) | 40 |
| 3 | The Standard Lamp with 10 mm x 10 mm on 15 mm x 20 mm Double Dimple. (Fig. 6B) | 43 |
| 4 | The Standard Lamp with the Aperture Dimple. (Figs. 7 + 7A) | 38 |
| 5 | The Standard Lamp with Dimpled Bulb and Metal Shield. (Fig. 9) | 40 |
| 6 | The Standard Lamp with Dimpled Bulb and Glass Shield. (Fig. 10) | 41 |

FIG. 11

ELECTRODELESS FLUORESCENT LAMP WITH CONTROLLED COLD SPOT TEMPERATURE

FIELD OF THE INVENTION

This invention relates to electrodeless fluorescent lamps and, more particularly, to electrodeless fluorescent lamps wherein mercury vapor pressure is controlled over a range of operating conditions, including low ambient temperatures and dimming.

BACKGROUND OF THE INVENTION

Dimming of fluorescent lamps has been achieved by modifications to electronic ballast designs for both mood effect and for energy conservation. Little or no change was required to the standard pure mercury, 32-watt, 4 foot T8 fluorescent lamp. Not all fluorescent lamps can be dimmed in a similar fashion. One problem is that the mercury vapor pressure is difficult to control under dimming conditions, since temperatures in the lamp envelope are significantly lowered.

In fluorescent lamps, optimum performance is dependent on controlling the mercury vapor pressure. The light output reaches a maximum at a specific mercury vapor pressure. The mercury vapor pressure increases with the temperature of the coldest spot inside the lamp envelope (the cold spot). The optimal cold spot temperature in the case of pure mercury is typically in a range of 38° to 42° C. To optimize light output, it is desirable to control the cold spot temperature in this range. Light output is reduced for cold spot temperatures above or below the optimum value.

Many compact fluorescent and high-output lamps have higher temperatures within the envelope due to relatively high power per unit volume. This requires special adaptations or the use of amalgams to achieve optimum mercury vapor pressure and performance. The optimum cold spot temperature for an amalgam is typically about 90° C.

In electrodeless fluorescent lamps, optimum performance is dependent on controlling mercury vapor pressure as in linear fluorescent lamps. Thus far, with the exception of very low power electrodeless lamps, amalgams have been selected to maintain optimum mercury vapor pressure.

The dimming of electrodeless fluorescent lamps by pulse width modulation utilizing amalgams incurs the problem of significantly reduced amalgam temperatures. The desire to operate at low temperature, such as −20° C., and with dimming to as low as 25% of the light output of the undimmed lamp may have the additional effect of producing a secondary cold spot which can deplete the amalgam of mercury and yield control of mercury vapor pressure to the secondary cold spot. Use of pure mercury rather than an amalgam eliminates the secondary cold spot under such conditions but reduces performance at +25° C., 100% duty cycle due to high mercury vapor pressure.

In the production of a sealed lamp envelope, an exhaust tube is used to evacuate and backfill with the desired gas. In other cases, particularly for pure mercury lamps, a tube is added to the lamp envelope to create a cold spot. The tube can be located far enough from the plasma so that temperature is appropriate for location of an amalgam or in some cases pure mercury. In some cases, the location and length of the exhaust tube can be adjusted to achieve sufficient distance from heat sources such as the plasma, driver and electrical circuits. In other cases, the manufacturing process, handling damage concerns and/or aesthetics preclude certain locations or lengths of the exhaust tube. Operating temperature range and dimming must also be considered in order to meet desired mercury vapor pressure to achieve performance requirements.

U.S. Pat. No. 6,172,452, issued Jan. 9, 2001 to Itaya et al., discloses a low pressure mercury vapor discharge lamp wherein an amalgam container and the base are connected by a heat conductive component to control amalgam temperature. U.S. Pat. No. 6,433,478, issued Aug. 13, 2002 to Chandler et al., discloses an electrodeless fluorescent lamp wherein the mercury pressure is controlled in the lamp envelope by the temperature of the amalgam positioned in a tubulation or by the temperature of pure mercury located in the cold spot. U.S. Pat. No. 6,359,376, issued Mar. 19, 2002 to Hollstein et al., discloses a fluorescent lamp wherein a thermally conducting material in the form of a coating of foil on the discharge tube in the region of one or both electrodes is used to achieve optimum operation. U.S. Pat. No. 5,808,418, issued Sep. 15, 1998 to Pitman et al., discloses a control mechanism for regulating the temperature of a fluorescent lamp tube. The control mechanism includes a cold spot mechanism defining a cold spot, a heating mechanism, a power supply and a temperature sensor. U.S. Pat. No. 5,773,926, issued Jun. 30, 1998 to Maya et al., discloses an electrodeless fluorescent lamp wherein the cold spot is maintained at a desired temperature by utilizing a portion of the induction coil to heat the amalgam. U.S. Pat. No. 5,581,157, issued Dec. 3, 1996 to Vrionis, discloses a lamp envelope for an electrodeless discharge lamp having a protuberance such that the cold spot of the lamp envelope is located in the protuberance.

All of the known prior art techniques for controlling cold spot temperature have had one or more drawbacks, including but not limited to limited operating ranges, excessive complexity and difficulties in production. Accordingly, there is a need for improved cold spot structures and control methods for electrodeless fluorescent lamps.

SUMMARY OF THE INVENTION

According to a first aspect of the invention, an electrodeless lamp comprises a bulbous lamp envelope enclosing an inert gas and a vaporizable metal fill, a lamp envelope having a reentrant cavity, an electromagnetic coupler positioned within the reentrant cavity, and a cold spot structure configured for low temperature, low duty cycle operation and for room temperature, 100% cycle operation.

According to a second aspect of the invention, an electrodeless lamp comprises a bulbous lamp envelope enclosing an inert gas and a vaporizable metal fill, the lamp envelope having a reentrant cavity; an electromagnetic coupler positioned within said reentrant cavity; and a cold spot structure including a dimple on the lamp envelope and a shield positioned near the dimple.

According to a third aspect of the invention, an electrodeless lamp assembly comprises a bulbous lamp envelope enclosing an inert gas and a vaporizable metal fill, the lamp envelope having a reentrant cavity and an exhaust tube within the reentrant cavity; an electromagnetic coupler positioned within said reentrant cavity; a lamp base affixed to the lamp envelope; and a cold spot structure including a heat sink in thermal contact with the exhaust tube and thermally isolated from the lamp base for conducting heat from the exhaust tube to external air.

According to a fourth aspect of the invention, an electrodeless lamp comprises a bulbous lamp envelope enclosing an inert gas and a vaporizable metal fill, the lamp envelope having a reentrant cavity; an electromagnetic coupler positioned within said reentrant cavity; and a cold spot structure including a dimple on the lamp envelope in gas communication with the lamp envelope, the dimple having a sidewall and an end wall, the sidewall of the dimple having a thickness that is less than a wall thickness of the lamp envelope.

BRIEF DESCRIPTION OF THE DRAWINGS

For a better understanding of the present invention, reference is made to the accompanying drawings, which are incorporated herein by reference and in which:

FIG. 11 is a table comparing the cold spot temperature of six configurations tested in base-up operation.

DETAILED DESCRIPTION

Figure 1:
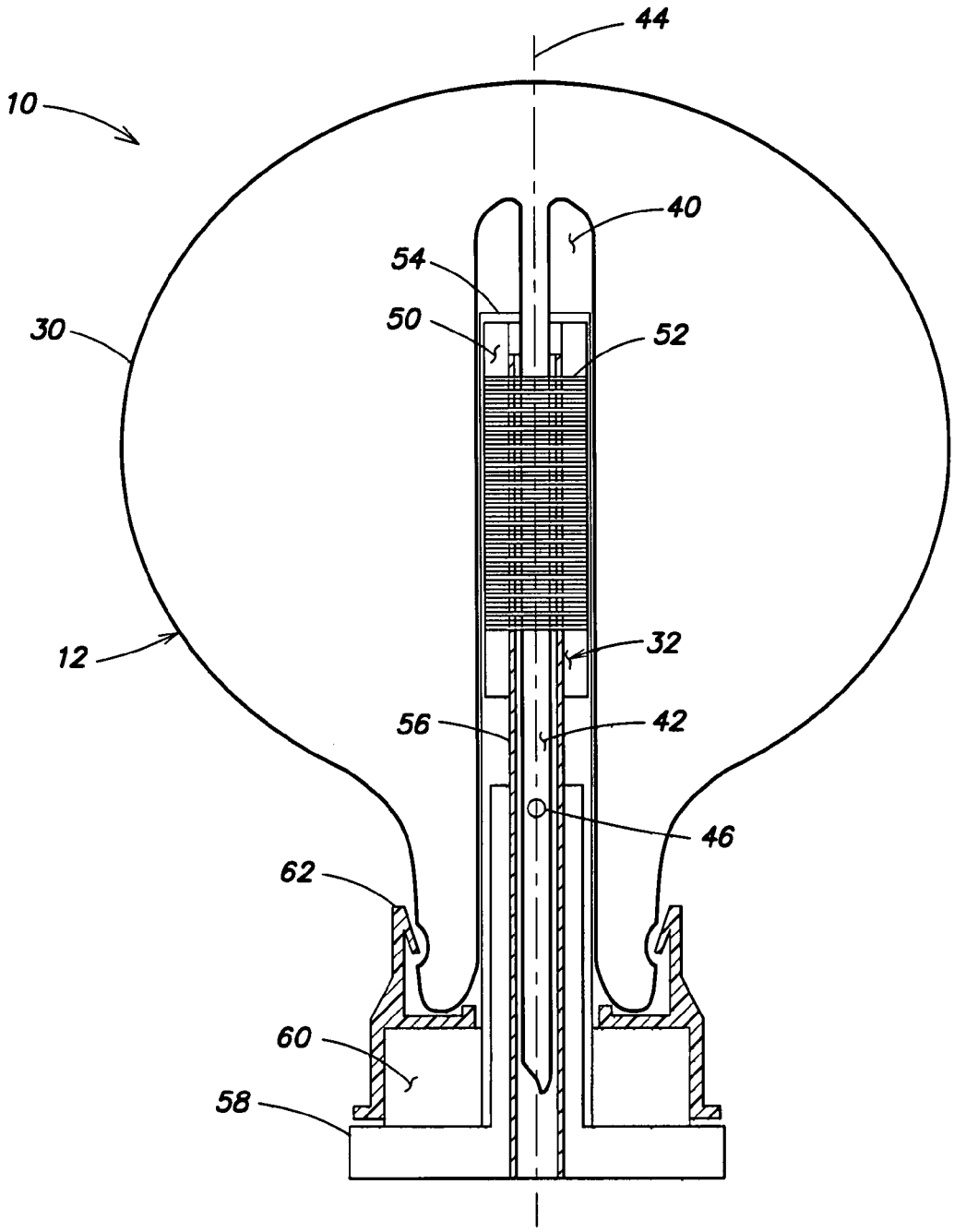
FIG. 1 is a schematic cross-sectional view of a prior art electrodeless fluorescent lamp.

A simplified cross-sectional diagram of a prior art lamp assembly is shown in FIG. 1. A lamp assembly 10 includes an electrodeless lamp 12 and a base fixture (not shown) for supporting lamp 12 and serving as a heat sink. Electrodeless lamp 12 includes a lamp envelope 30 and an electromagnetic coupler 32.

Lamp envelope 30 may be made from glass and may have a bulbous shape, as shown in FIG. 1. Lamp envelope 30 includes a reentrant cavity 40 with an exhaust tube 42 located inside reentrant cavity 40 on a cavity axis 44. Reentrant cavity 40 may have a generally cylindrical shape. The diameter of the lamp envelope 30 may be in a range of 29 mm (millimeters) to 500 mm and in a preferred embodiment is 160 mm. The height of lamp envelope 30 may be in a range of 25 mm to 500 mm and in a preferred embodiment is 180 mm. The diameter of reentrant cavity 40 may be in a range of 10 mm to 200 mm and in a preferred embodiment is 32 mm. The length of reentrant cavity 40 may be in a range of 10 to 490 mm and in a preferred embodiment is 160 mm. The length of exhaust tube 42 may be in a range of 10 to 510 mm and in a preferred embodiment is 170 mm. The diameter of exhaust tube 42 may be in a range of 3 to 20 mm and in a preferred embodiment is 6 mm.

An inert fill gas, such as argon, krypton, or the like, may have a pressure in a range of 0.01 Torr to 5 Torr in lamp envelope 30. In a preferred embodiment, argon at a pressure in a range of 20 to 100 mTorr is utilized. The inside wall of lamp envelope 30 and reentrant cavity 40 may be coated with a protective coating and a phosphor coating. The inside surface of reentrant cavity 40 (the surface exposed to the interior of the lamp envelope) sometimes can also be coated with a reflective coating.

A mercury amalgam 46 is positioned in exhaust tube 42 and controls the mercury vapor pressure in the lamp envelope 30. Several glass pieces (not shown) may hold the amalgam 46 in a fixed position that is optimum to provide mercury vapor pressure in lamp envelope 30 within a range of ambient temperatures.

Electromagnetic coupler 32 is located in reentrant cavity 40 and includes a magnetic core 50, an induction coil 52, a bobbin 54, a support tube 56, a base 58 and a flange 60. The magnetic core 50 and bobbin 54 are attached to support tube 56 and base 58. Induction coil 52 is wound around magnetic core 50, and the leads of coil 52 extend through bobbin 54 to an external driver. Bobbin 54 is attached to base 58 via flange 60, which also provides locking slots for a flange 62 that attaches to lamp envelope 30.

Induction coil 52 may be made from multiple strand wire, such as Litz wire, wound around magnetic core 50. The magnetic core 50 may be made from a ferrite material, such as MnZn material. Additional details of the ferrite core are provided in published U.S. application Ser. No. 2002/0067129 A1, which is hereby incorporated by reference. The magnetic core 50 and induction coil 52 are positioned along cavity axis 44 so that the center of core 50 is approximately positioned where the diameter of the lamp envelope 30 is maximum.

To limit propagation of visible light through the wall of reentrant cavity 40 and heating of electromagnetic coupler 70, a reflective coating may be deposited on the atmospheric side of cavity wall 40*a* of reentrant cavity 40. The visible light is reflected from the cavity wall into lamp envelope 30 and eventually radiates from the lamp envelope surface, thereby increasing the total light output.

A thermal analysis of lamp envelope 30 identified no appropriate location where the temperature of an amalgam can control the mercury vapor pressure for all ambient environments and dimming levels that were desired. The lamp is required to operate over a range of ambient temperatures from −20° to +60° C. and under dimming conditions of 25% to 100% light output. The location of the amalgam inside the exhaust tube 42 produced a higher mercury vapor pressure than would be produced by condensed mercury at the coldest locations on the lamp envelope at low temperatures under dimming conditions, yielding control of mercury vapor pressure to the condensed mercury at the cold spot on the lamp envelope away from the amalgam. In addition, no location was cool enough for pure mercury to control the lamp at +25%. This combination of conditions in the prior art electrodeless lamp leads to the present invention.

Figure 2:
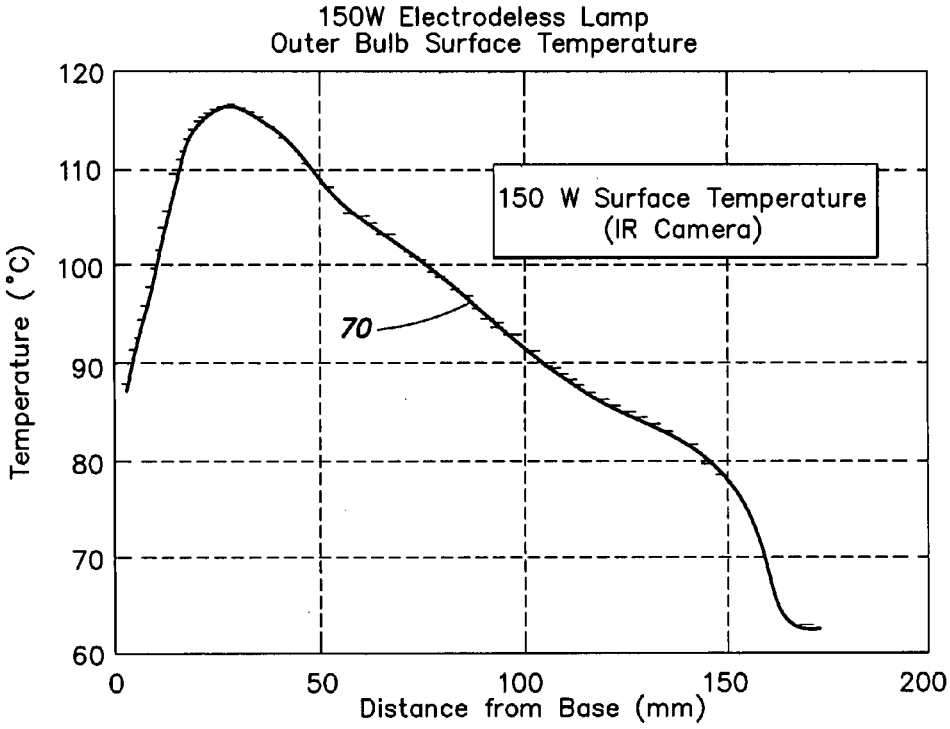
FIG. 2 is a graph of lamp envelope surface temperature as a function of distance from the base for base-up operation.
Figure 3:
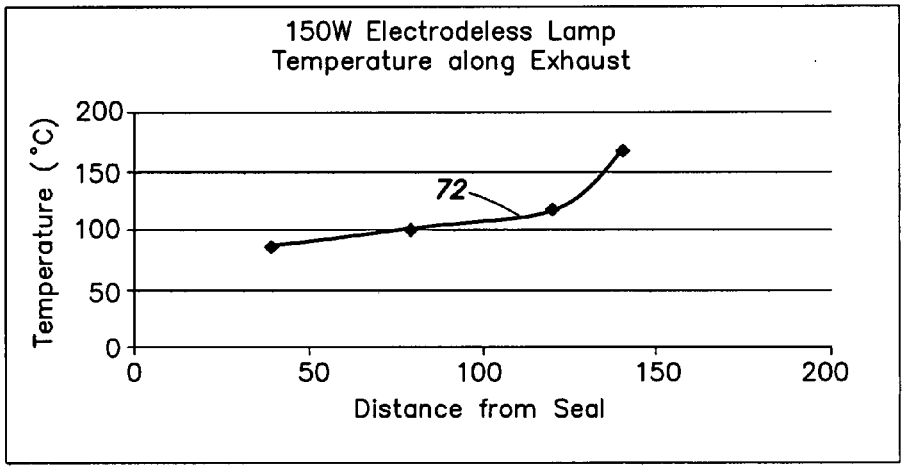
FIG. 3 is a graph of exhaust tube temperature as function of distance from the seal for base-up operation.

The results of the thermal analysis are shown in FIGS. 2 and 3 for a 150-watt an electrodeless fluorescent lamp. In FIG. 2, the surface temperature of the lamp envelope is plotted in curve 70 as a function of distance from the base, as measured with an infrared camera. In FIG. 3, the temperature along the exhaust tube is plotted in curve 72 as a function of distance from the exhaust tube seal. In each case, temperature was measured in base-up operation.

Figure 4:
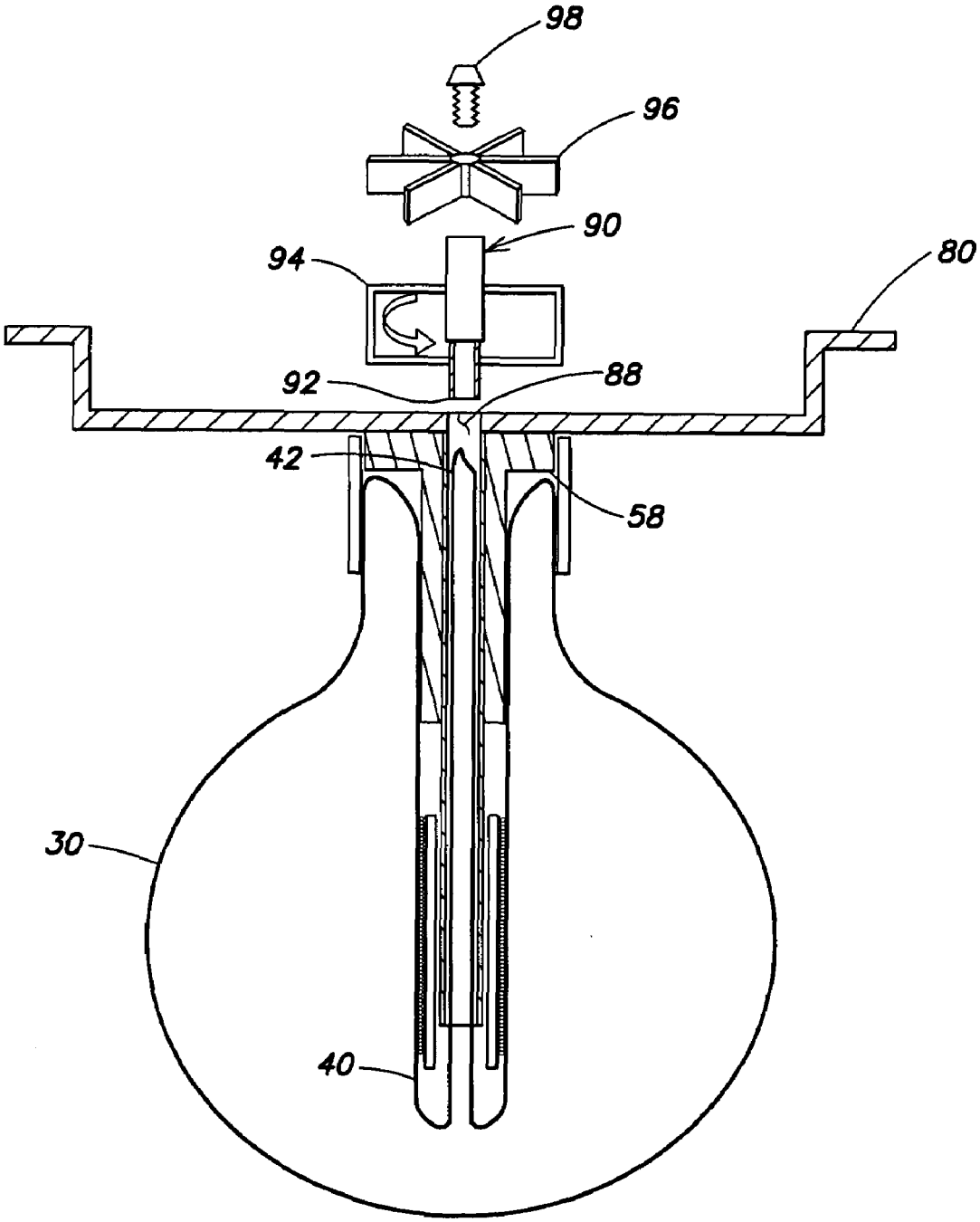
FIG. 4 is a schematic, exploded cross-sectional view of an electrodeless fluorescent lamp including a heat sink on the exhaust tube.

A first embodiment of the invention is shown in FIG. 4. The prior art lamp assembly of FIG. 1 is modified as follows. A drop of mercury, preferably 3-8 milligrams, is placed in the lamp envelope 30 instead of the amalgam. When the lamp is integrated into the coupler, exhaust tube 42 is centered in a 10 mm hole 88 in base 58 and a base plate 80. The control of the cold spot temperature is accomplished by access to exhaust tube 42 through the hole 88 in base 58 and base plate 80. A thermally-conductive material, such as a copper rod, is placed in the hole in base 58 and base plate 80. The thermally-conductive rod 90 has a hollow end 92 to receive exhaust tube 42. The rod 90 is thermally isolated with insulating ceramic tape 94 wrapped around the rod 90 and secured with epoxy dots. In one embodiment, mylar tape was used. The rod diameter may vary depending on the thermally insulating tape 94 selected, but sufficient spacing must be provided to insulate rod 90 from base 58 and base plate 80. In the present example, the hole 88 was 10 mm and the exhaust tube 42 was 6 mm to define a 9 mm maximum diameter of rod 90 to allow two thicknesses of thermally insulating tape 94. Hollow end 92 of rod 90 was 6.3 mm inside diameter and was partially filled with a thermal compound to fill the gap between exhaust tube 42 and rod 90. A radiator 96 of appropriate size, typically 2-4 centimeters (cm), depending on nominal ambient temperature, is affixed to the end of rod 90 with a fastener 98 and extends into ambient air. A 3 cm transistor radiator 96 was sufficient to cool the tip of exhaust tube 42 to 44° C. in room ambient temperature of 25° C. when the lamp was operated at 150 watts.

Figure 5:
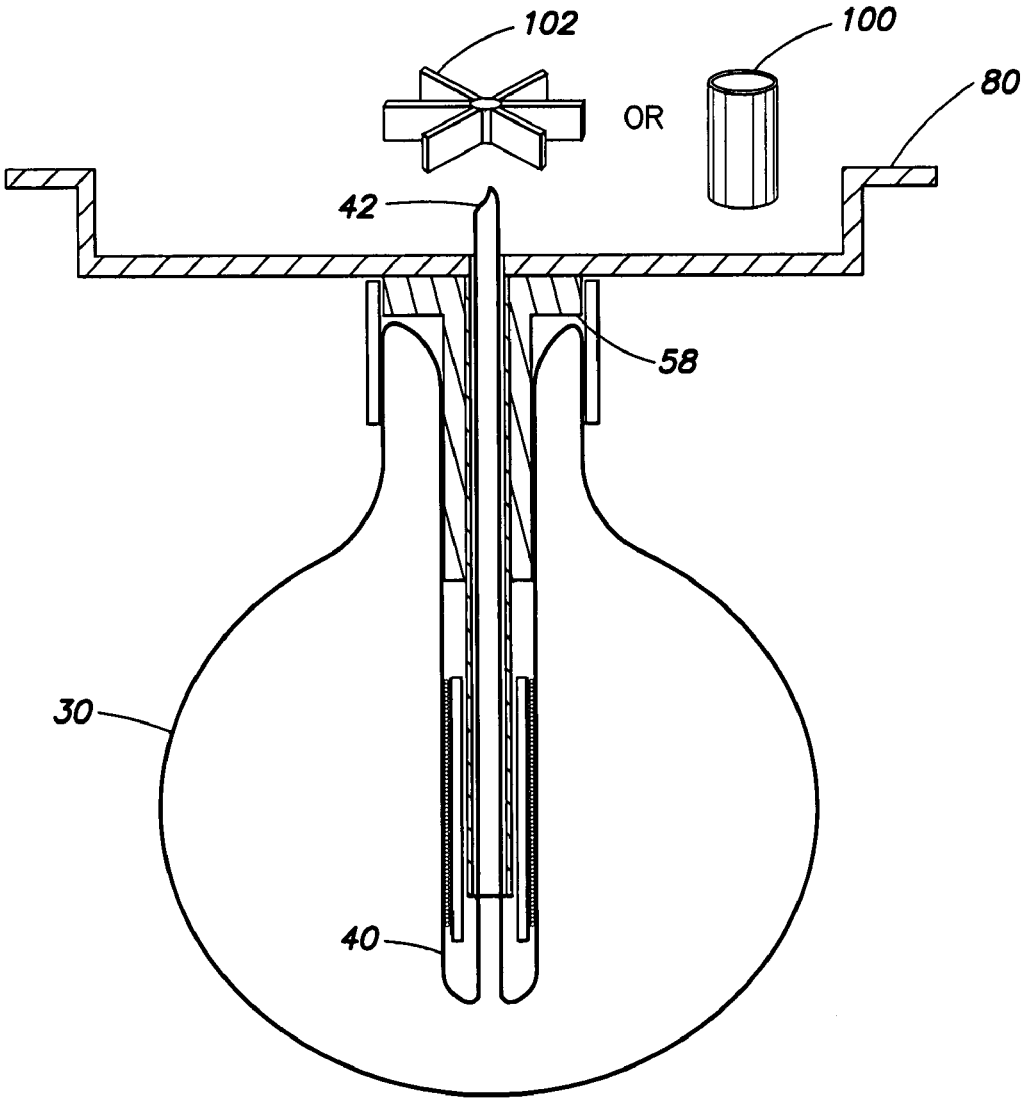
FIG. 5 is a schematic, exploded cross-sectional view of an electrodeless fluorescent lamp including a heat sink on an extended exhaust tube.

A lamp assembly in accordance with a second embodiment of the invention is shown in FIG. 5. The prior art lamp assembly of FIG. 1 is modified as follows. Exhaust tube 42 is extended through hole 88 in base 58 and base plate 80 into ambient air. In one example, exhaust tube 42 is extended 4 cm by moving the location where a flame tips off the exhaust tube. A drop of mercury, preferably 3-8 milligrams, is placed in the lamp instead of an amalgam. Control of cold spot temperature is accomplished by the access to exhaust tube 42 extending through hole 88 in base 58 and base plate 80 into ambient air. A thermal radiator is attached to the portion of exhaust tube 42 that extends through base plate 80. In one example, a thermally conductive tube 100 provides sufficient surface area to maintain optimum mercury vapor pressure. By way of example, thermally conductive tube 100 may be a 2-3 cm length of copper tube having an outside diameter of 8 mm and an inside diameter of 6.3 mm. Thermal contact may be provided by sealing the radiator to exhaust tube 42 with thermal compound. A copper tube as described above was sufficient to cool the tip of exhaust tube 42 to 40° C. in room ambient temperature of 25° C. when the lamp was operated at 150 watts.

In a third embodiment, also illustrated in FIG. 5, control of cold spot temperature is accomplished by access to an extension of exhaust tube 42 through hole 88 in base 58 and base plate 80. Instead of thermally conductive tube 100, a finned radiator 102 is sealed to exhaust tube 42 with thermal compound. In one example, finned radiator 102 was a 2 cm diameter transistor radiator, which was sufficient to cool the tip of exhaust tube 42 to 38°-40° C. in room ambient temperature of 25° C. when the lamp was operated at 150 watts.

In the following embodiments, prior to sealing of the lamp envelope a dimple is formed in the central portion of the dome of lamp envelope 30 to create a cold spot. The morphology of the dimple in terms of its glass thickness and shape are critical to the functions of reducing thermal transfer while maintaining structural integrity. The sidewalls of the dimple are 0.4-0.8 mm in thickness, while the end wall of the dimple is 1.6-1.8 mm in thickness (the lamp envelope thickness). The thinned sidewall of the dimple should not exceed 15 millimeters in height without violating the minimum thickness or the maximum span that the thinned glass can reliably sustain under standard processing, handling and operating conditions.

In one method for forming a dimple, the dome of the lamp envelope is heated to soften the glass, and a carbon rod is pressed from the inside of the lamp envelope to form a dimple. The carbon rod has the approximate curvature of its radius. The rod is pressed from the inside as the dome of the lamp envelope is heated by a gas torch such that both the glass dome of the lamp envelope and to a lesser extent the carbon rod are heated. The glass near the area of contact with the carbon rod becomes plastic before the glass in contact with the carbon rod, since heat is not dissipated into the carbon rod in the surrounding area. When the glass temperature reaches its plastic transition temperature in the region near the carbon rod, the dimple begins to form as the rod deforms the glass dome. The sidewalls of the dimple are thinned, typically from 1.6 mm to 0.6 mm, as the rod is pressed into the glass, while the top portion thins very little. The thicker end wall permits a repeated process of dimpling with smaller diameter rods centered in the top of the previous dimple.

Multiple dimpling steps may be needed to achieve the required thermal differential without excessive thinning of the glass, to less than 0.4 millimeters. By accumulating experience as to the degree of heating with the flame and rate of insertion of the carbon rod and small changes in the curvature of the end of the carbon rod, it can be determined how to achieve a thinned glass wall. Many alternative glass molding and glass blowing techniques, not discussed herein, may be utilized to achieve the same cross section of thinned and thick glass. While the methods may vary, the successive thin and thick regions of glass produce a reduction of thermal transfer to the cold spot while maintaining structural integrity in the glass and requiring no additional glass.

Figure 6A:
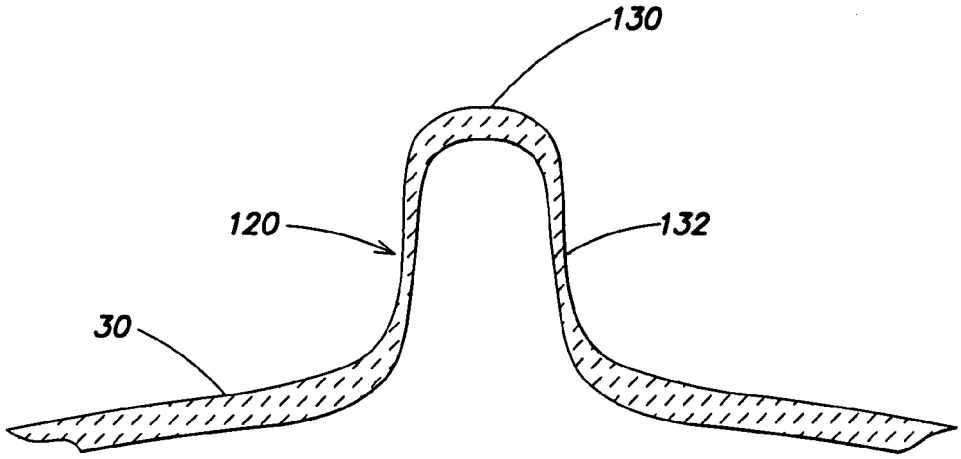
FIG. 6A is a partial cross-sectional view of a lamp envelope having a dimple with a thinned sidewall.

A dimple 120 in accordance with a fourth embodiment of the invention is shown in FIG. 6A. Dimple 120 may be formed using the above-described techniques. Dimple 120 has an end wall 130 with approximately the same thickness as the remainder of lamp envelope 30 and a sidewall 132 that is thinned in comparison with the standard wall thickness as described above. By way of example, dimple 120 may have a diameter of 10 millimeters and a height of 10 millimeters.

Figure 6B:
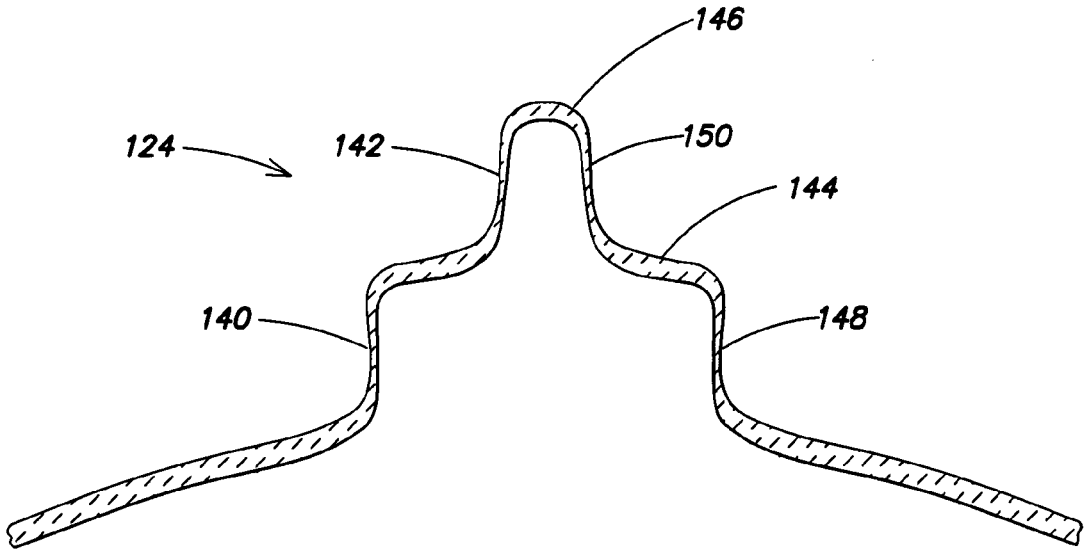
FIG. 6B is a partial cross-sectional view of a lamp envelope having first and second dimples with thinned sidewalls.

A composite or double dimple 124 in accordance with a fifth embodiment of the invention is shown in FIG. 6B. Composite dimple 124 includes a first dimple 140 of relatively larger diameter and a second dimple 142 of relatively smaller diameter formed in first dimple 140. An end wall 144 of first dimple 140 and an end wall 146 of second dimple 142 have the approximate wall thickness of lamp envelope 30. A sidewall 148 of first dimple 140 and a sidewall 150 of second dimple 142 are thinned in comparison with the end wall thicknesses. Dimples 140 and 142 may be concentric. By way of example, first dimple 140 may have a diameter of 20 millimeters and a height of 15 millimeters, and second dimple 142 may have a diameter of 10 millimeters and a height of 10 millimeters. It will be understood that these dimensions are given by way of example only and are not limiting as the scope of the invention. A composite dimple may include two or more dimples.

In accordance with a further feature of the invention, the dimple may be shielded to assist in cold spot temperature control. In particular, a shield may be placed in front of the dimple opening to at least partially shield the interior of the dimple from the plasma in lamp envelope 30. The shield may be spaced from the dimple opening. The shield permits gas flow into the dimple but at least partially blocks heating of the dimple by convection and radiation. The amount of shielding can be adjusted for a particular application. Use of the shield permits the size of the dimple and the number of dimples in a composite dimple required to achieve the desired cold spot temperature to be reduced.

Figure 7:
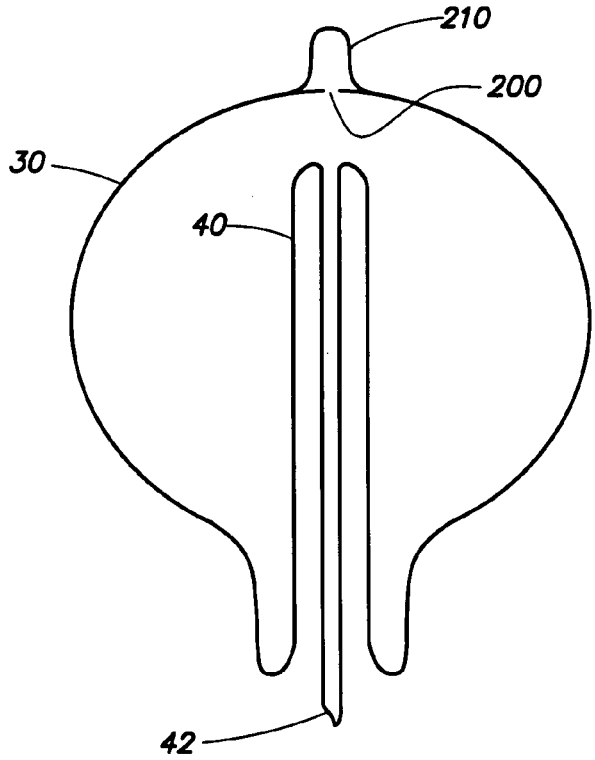
FIG. 7 is a cross-sectional view of a lamp envelope having a dimple and an envelope portion defining an aperture in front of the dimple.
Figure 7A:
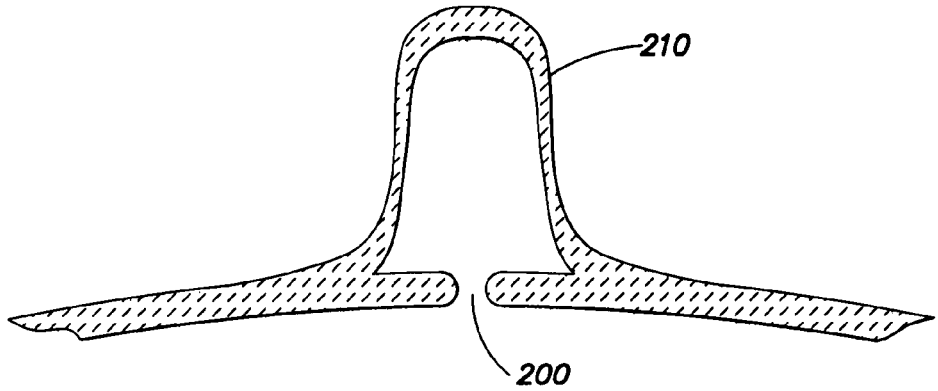
FIG. 7A is an enlarged detail of the dimple and aperture of FIG. 7.

A dimple and shield configuration in accordance with a sixth embodiment of the invention is illustrated in FIGS. 7 and 7A. Prior to sealing the lamp envelope, the central portion of the dome of the lamp envelope is heated to open an aperture 200 having a diameter of about 1-3 mm. A dimple 210 is formed externally of the lamp envelope by sealing a 10 mm to 20 mm glass cylinder over aperture 200. The attached glass cylinder is heated and is pulled to thin the glass and then is flame cut and domed to provide a 15 mm height. A drop of mercury, preferably 3-8 milligrams, is placed in the lamp envelope 30 in place of the amalgam. Heat transfer to the top of dimple 210 is limited both by the thinning of the glass and by the partial blocking of radiation from the plasma and reduced thermal transfer from the heated buffer gas. This embodiment permitted a reduction in the size of the dimple in comparison with unshielded embodiments. In addition, the temperature was reduced from 80° C. at the top of the dome to 40°-44° C. at the top of dimple 210 at room ambient temperature of 25° C.

Figure 8:
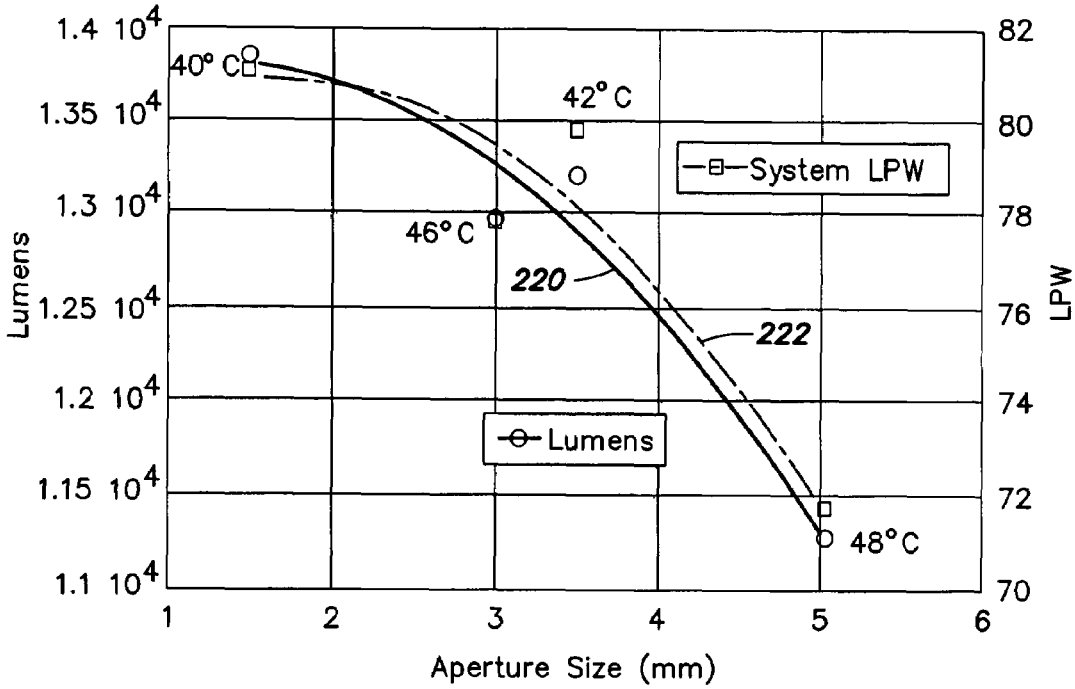
FIG. 8 is a graph of lumens and lumens per watt as a function of aperture size for an electrodeless fluorescent lamp having a dimple and an aperture as shown in FIGS. 7 and 7A.

The performance of a 150-watt electrodeless fluorescent lamp is plotted in FIG. 8 as a function of the size of aperture 200. The dimple 210 was 15 millimeters deep and 10 or 20 millimeters in diameter, and measurements were taken in the base-up orientation. Lumens are represented by curve 220, and system lumens per watt are represented by curve 222.

Figure 9:
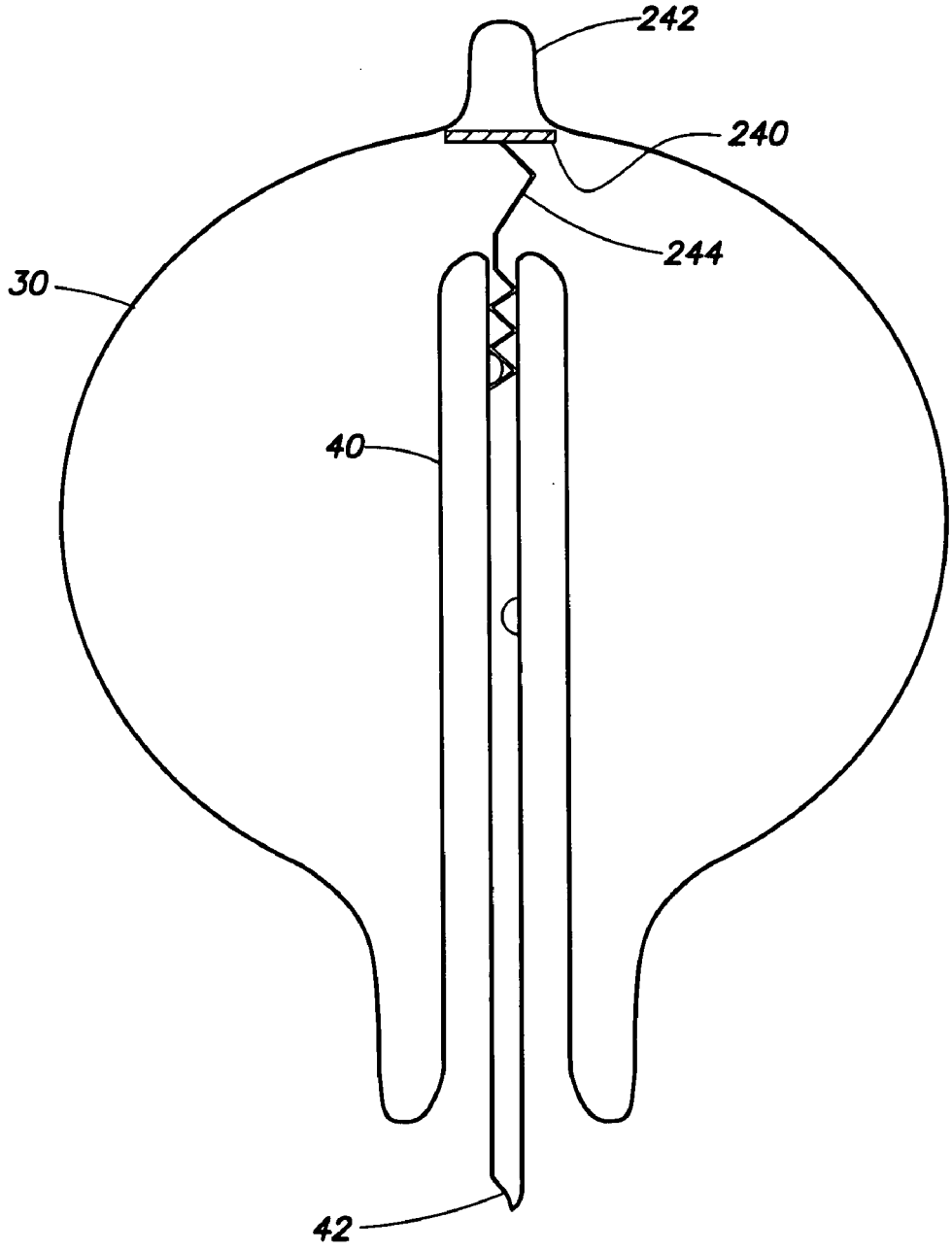
FIG. 9 is a schematic cross-sectional view of a lamp envelope having a dimple and a metal shield positioned in front of the dimple.

A dimple and shield configuration in accordance with a seventh embodiment of the invention is shown in FIG. 9. In the embodiment of FIG. 9, a metal shield 240 is positioned in front of a dimple 242 in lamp envelope 30. Prior to sealing the lamp envelope 30, the central portion of the dome is heated to soften the glass, and a carbon rod is pressed from the inside of the lamp envelope to form a single dimple 242, which may have a diameter of 10 mm and a depth of 13-15 mm. After phosphor coating the lamp envelope but prior to bakeout and sealing of reentrant cavity 40 to lamp envelope 30, metal shield 240 is positioned in front of dimple 242 internal to the lamp envelope. A nickel shield, which may have a thickness of 0.15 mm and a dimension of 20 mm (square or round) is welded to a wire 244, which may be 6 cm in length. The wire 244 is initially bent 90° from the plane of shield 240 and then is slightly bent approximately every 10 mm such that the wire runs away from the center of shield 240 perpendicular to its plane. After degreasing, etching and drawing of shield 240, the wire is inserted in exhaust tube 42 until the shield 240 is between 15 and 20 mm from the end of reentrant cavity 40. The small bends provide sufficient mechanical resistance to sliding in exhaust tube 42 to hold shield 240 in place.

The modifications to the prior art lamp assembly of FIG. 1 include addition of dimple 242, metal shield 240 and wire 244, and placement of a drop of mercury, preferably 3-8 milligrams, in the lamp envelope instead of the amalgam. Dimple 242 is shaded from plasma radiation by shield 240 being centered and positioned 1-5 mm below the dimple after sealing the lamp envelope to reentrant cavity 40. This configuration reduced the temperature from 80° C. at the top of the dome to 40°-44° C. at the top of dimple 242 at room ambient temperature of 25° C.

In a variation of the embodiment of FIG. 9, a reflective coating is applied to metal shield 240 to reduce the dark spot caused by shield 240. After degreasing, etching and drawing of the shield assembly as described above, the shield 240 is spray coated with an alumina coating and a binder solution yielding 2-3 milligrams per square centimeter alumina coating after bakeout of suspension. In other respects, the lamp is fabricated as described above in connection with FIG. 9. The shadow of the shield was reduced by the scattering of light from the reflective coating on shield 240.

Figure 10:
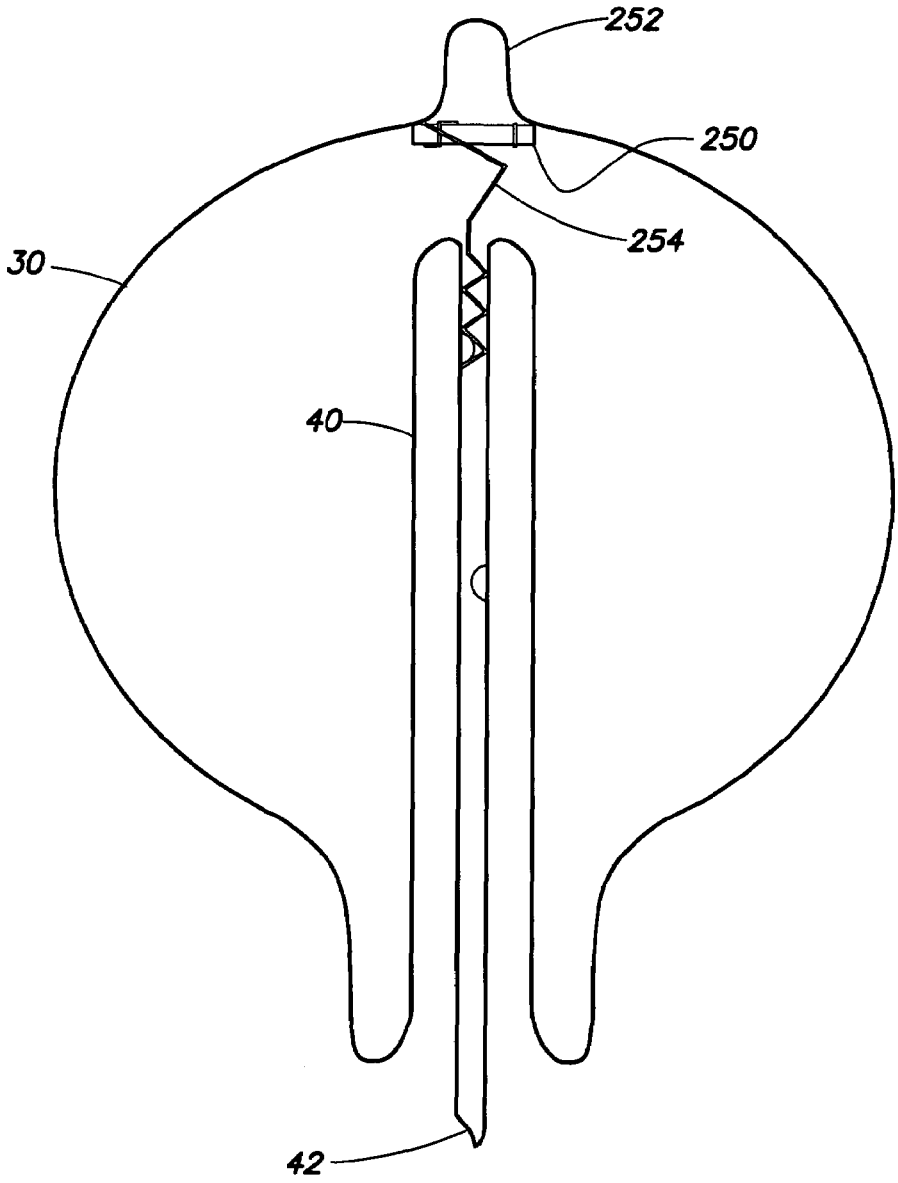
FIG. 10 is a schematic cross-sectional view of a lamp envelope having a dimple and a glass shield positioned in front of the dimple.

A dimple and shield configuration in accordance with an eighth embodiment of the invention is shown in FIG. 10. To reduce the shadow produced by the shield, a glass shield 250 is positioned in front of a dimple 252. Prior to sealing lamp envelope 30, the central portion of the dome is heated to soften the glass, and a carbon rod is pressed from the inside of the lamp envelope to form a single dimple 250 having a 10 mm diameter and a depth of 13-15 mm. After phosphor coating of lamp envelope 30 and reentrant cavity 40, but prior to bakeout and sealing of reentrant cavity 40 to lamp envelope 30, shield 250 is positioned in front of dimple 252 inside the lamp envelope. Glass shield 250, having a thickness of 1.2 mm and a dimension of 20 mm (square, circular, or octagonal) is attached to a wire 254. Wire 254 is inserted into exhaust tube 42. Many techniques can be used for attaching wire 254 to glass shield 250. One simple method used for the embodiment of FIG. 10 was by wrapping the wire 254 around the edges of the glass shield to form a nest that captures the glass shield 250. A remaining length of wire 254 is initially bent 90° from the plane of shield 250 and is then slightly bent approximately every 10 mm such that the wire 254 runs away from the center of shield 250 perpendicular to its plane. After degreasing, etching and drawing of the shield assembly, wire 254 is inserted into the exhaust tube 42 such that shield 250 is between 15 and 20 mm above the end of reentrant cavity 40. The bends in wire 254 provide sufficient mechanical resistance to sliding in exhaust tube 42 to hold glass shield 250 in place.

The modifications to the prior art lamp assembly of FIG. 1 include dimple 252, shield 250 and wire 254, and the use of a drop of mercury, preferably 3-8 milligrams, in the lamp envelope instead of the amalgam. The dimple 252 is shaded from plasma radiation by the shield 250 being centered and positioned 1-5 mm below the dimple 252 after sealing lamp envelope 30 to reentrant cavity 40. The configuration of FIG. 10 reduced the temperature from 80° C. at the top of the dome to 40°-44° C. at the top of dimple 252 at room ambient temperature of 25° C.

In a variation of the embodiment of FIG. 10, a reflective coating is applied to glass shield 250 to reduce radiation transmitted by glass shield 250 while minimizing the dark spot caused by shading. An alumina coating can be spray coated on the glass shield 250 as described above in connection with FIG. 9. The shadow of the shield is reduced by the scattering of light from the reflective coating on shield 250.

The cold spot temperatures obtained with the embodiments of FIGS. 4, 5, 6B, 7 and 7A, 9 and 10 are summarized in the table of FIG. 11. The cold spot temperatures were measured at room ambient of 25° C. with a 150-watt electrodeless fluorescent lamp. The temperatures are favorable for operation with pure mercury.

Figure 12:
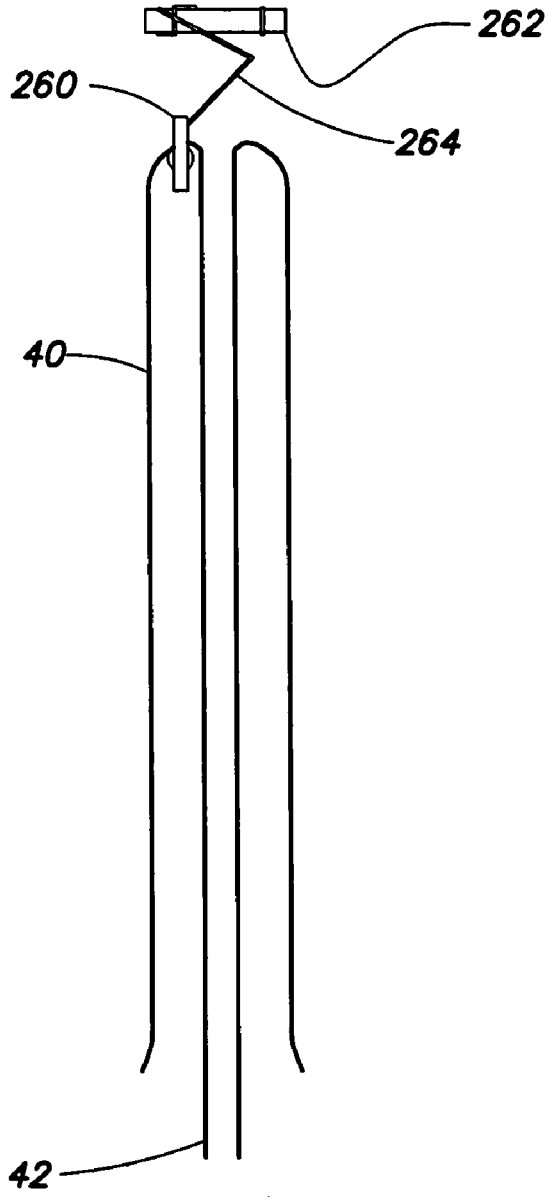
FIG. 12 is a partial cross-sectional view of an electrodeless fluorescent lamp envelope, showing attachment of the shield to the reentrant cavity.

Many configurations may be utilized for positioning the shield in front of the dimple. In one approach described above, the shield is held in place by insertion of a wire with many bends into the exhaust tube to create interference resistance without blocking the exhaust tube. Another attachment method may be required for environments where vibration can potentially cause movement of the shield. One approach is illustrated in FIG. 12. In FIG. 12, reentrant cavity 40 and exhaust tube 42 are illustrated, and the remainder lamp envelope 30 is omitted for ease of illustration. In the embodiment of FIG. 12, a wire post 260 is sealed into the end of reentrant cavity 40. A shield 262 is supported in a desired position relative to the dimple by a wire 264 attached to wire post 260. Typically, the shield 262 is positioned 15-20 millimeters above reentrant cavity 40. Shield 262 may be a glass or metal shield with or without a reflective coating. It will be understood that different shield materials, sizes and shapes may be utilized within the scope of the invention.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An electrodeless lamp comprising:

a bulbous lamp envelope enclosing an inert gas and a vaporizable metal fill, the lamp envelope having a reentrant cavity and having a non-amalgam configuration;

an electromagnetic coupler positioned within said reentrant cavity; and a cold spot structure comprising a dimple in the lamp envelope, a shield positioned near the dimple between the dimple and a discharge in the lamp envelope to limit heating of the dimple by shading the dimple from plasma radiation generated by the discharge in the lamp envelope, and a shield support configured to support the shield near the dimple.

2. An electrodeless lamp as defined in claim 1, wherein the dimple comprises a first dimple in the lamp envelope and a second dimple in the first dimple.

3. An electrodeless lamp as defined in claim 2, wherein at least one of the first and second dimples has a sidewall having a thickness that is less than a wall thickness of the lamp envelope.

4. An electrodeless lamp as defined in claim 1, wherein the dimple has a sidewall having a thickness that is less than a wall thickness of the lamp envelope.

5. An electrodeless lamp as defined in claim 1, wherein the shield comprises a thermally-conductive material.

6. An electrodeless lamp as defined in claim 5, wherein the thermally-conductive material comprises a metal.

7. An electrodeless lamp as defined in claim 1, wherein the shield comprises a thermally-insulating material.

8. An electrodeless lamp as defined in claim 7, wherein the thermally-insulating material comprises glass.

9. An electrodeless lamp as defined in claim 1, wherein the shield is coated with a light-reflecting material.

10. An electrodeless lamp as defined in claim 1, wherein the shield is coated with a phosphor material.

11. An electrodeless lamp as defined in claim 1, wherein the shield support is secured to an exhaust tube of the lamp envelope.

12. An electrodeless lamp as defined in claim 1, wherein the shield support is secured to the reentrant cavity.

13. An electrodeless lamp as defined in claim 1, wherein the vaporizable metal fill comprises mercury.

14. An electrodeless lamp comprising:

a bulbous lamp envelope enclosing an inert gas and a vaporizable metal fill, the lamp envelope having a reentrant cavity;

an electromagnetic coupler positioned within said reentrant cavity; and a cold spot structure including a first dimple on the lamp envelope in gas communication with the lamp envelope and a second dimple in the first dimple, wherein the first and second dimples are both convex toward an outside of the lamp envelope, wherein at least one of the first and second dimples has a sidewall having a thickness that is less than a wall thickness of the lamp envelope.

15. An electrodeless lamp comprising:

a bulbous lamp envelope enclosing an inert gas and a vaporizable metal fill, the lamp envelope having a reentrant cavity;

an electromagnetic coupler positioned within said reentrant cavity; and a cold spot structure including a first dimple on the lamp envelope in gas communication with the lamp envelope and a second dimple in the first dimple, wherein the first and second dimples are both convex toward an outside of the lamp envelope, wherein the first dimple is formed in a dome of the bulbous lamp envelope.

* * * * *